US005388633A

United States Patent [19]

Mercer, II et al.

[11] Patent Number: 5,388,633

[45] Date of Patent: Feb. 14, 1995

[54] METHOD AND APPARATUS FOR CHARGING METAL TO A DIE CAST

[75] Inventors: William E. Mercer, II, Clute; Carl F. Baker; Harvey L. King, both of Lake Jackson, all of Tex.

[73] Assignee: The Dow Chemical Company, Midland, Mich.

[21] Appl. No.: 17,099

[22] Filed: Apr. 15, 1993

Related U.S. Application Data

[63] Continuation-in-part of Ser. No. 837,298, Feb. 13, 1992.

[51] Int. Cl.[6] ..... B22D 39/02; B22D 17/10; B22D 17/30

[52] U.S. Cl. ..... 164/457; 164/136; 164/155.7; 164/155.4; 164/312; 164/337

[58] Field of Search ..... 164/3, 4.1, 133, 136, 164/155, 312, 304, 305, 335, 337, 500, 250.1, 457, 155.5, 155.6, 155.7, 150.1, 155.3; 266/230

[56] References Cited

U.S. PATENT DOCUMENTS

| | | | |
|---|---|---|---|
| 2,015,111 | 9/1935 | Jacobson | 164/337 |
| 3,196,502 | 7/1965 | Wagner | 164/150.1 |
| 3,252,187 | 5/1966 | Burkett | 164/312 |
| 4,493,362 | 1/1985 | Moore | 164/312 |
| 5,207,267 | 5/1993 | Iwamoto et al. | 164/155.5 |

FOREIGN PATENT DOCUMENTS

| | | | |
|---|---|---|---|
| 1447606 | 6/1966 | France . | |
| 3611914 | 10/1987 | Germany | 164/258 |
| 60-92060 | 5/1985 | Japan | 164/457 |
| 1241373 | 9/1989 | Japan | 164/500 |
| 3258448 | 11/1991 | Japan . | |
| 1113210 | 9/1983 | U.S.S.R. . | |
| 1052332 | 11/1983 | U.S.S.R. | 164/500 |

OTHER PUBLICATIONS

*Patent Abstracts of Japan,* vol. 16, No. 62 (M-1211) Feb. 17, 1992 (JP,A,32 58 448).

P. Koch in *GieBerei-Praxis,* NR 9 1908 "Verbesserung der Reproduzierbarkeit beim Druckgiessen durch Steuerung undRegelung der wichtigsten Einflussgrossen"; May 10, 1980; pp. 115-120.

Alfred Adamec in "Gewichtsdosierende Metallzuteilung bei Druckgussmaschinen" *Giessereitechnik 11 Jahrgana Heft 7,* 1965, pp. 203-206.

*Primary Examiner*—P. Austin Bradley
*Assistant Examiner*—Erik R. Puknys

[57] ABSTRACT

An automatic ladling system is described for delivering a molten metal to the mold or die of a molding or casting machine. The ladling system comprises a programmable logic controller (PLC) for monitoring and controlling the sequential delivery of shots of a precise quantity of molten metal from a furnace or holding pot to a shot delivery apparatus of the casting machine. In the preferred system, the PLC also monitors and/or controls the temperature of the molten metal in the holding pot, the temperature of the molten metal in a metal transfer system, the operation of a pump for pumping molten metal from the holding pot to the shot delivery apparatus, the level of molten metal in the pot, and the operation of the casting machine.

29 Claims, 1 Drawing Sheet

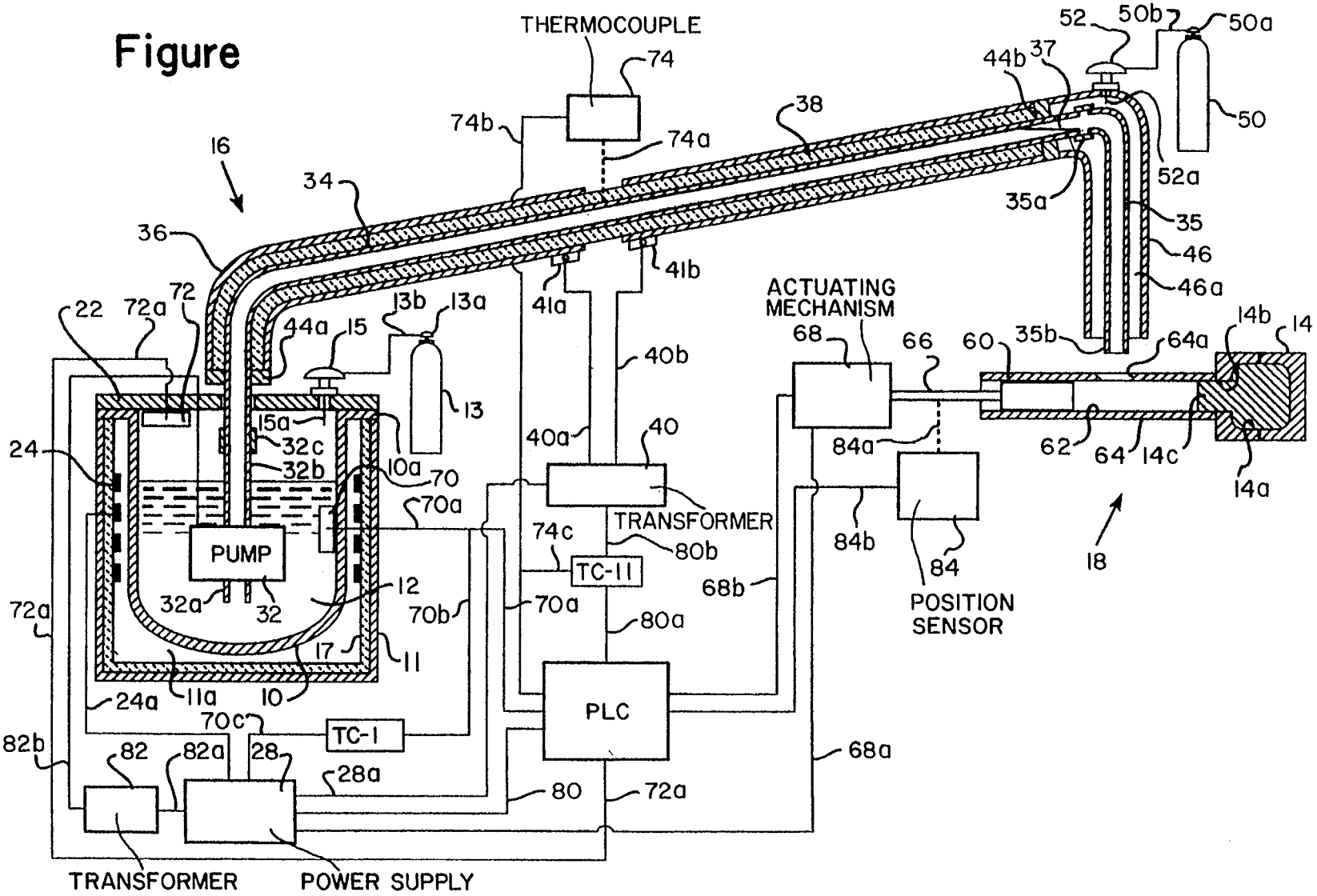
Figure

METHOD AND APPARATUS FOR CHARGING METAL TO A DIE CAST

CROSS REFERENCE TO RELATED APPLICATIONS

This application is a continuation-in-part of application Ser. No. 07/837,298, filed Feb. 13, 1992, for a Method and Apparatus for Handling Molten Metals.

BACKGROUND OF THE INVENTION

Within the last fifty years the art of metal casting has made significant advances with the advent of die casting machines and continuous strip casters. While advances have been made in the die casting machines only a few changes have occurred in the techniques for delivery of the molten metal to the die casting machine. The industry, for the most part, still delivers the molten metal manually to the die casting machine in heated ladles or heated tiltable crucibles.

Hand ladles are commonly used for transporting the molten metal from a furnace or holding pot to the mold or the die casting machine. However, hand ladles rely heavily on the experience of the operator to measure exact volumes of metal into a ladle and of transporting the metal to the mold. Hand ladling is limited by the stamina of the operator to pour a large number of parts. It also becomes less practical as the shot size increases. Although automatic ladling with the use of a robot arm is a possibility, it is not used commercially in the magnesium die casting industry. In both systems, the lack of a good mold wash for magnesium and the difficulty of protecting the metal from the atmosphere during transfer from the melting pot to the mold are prime concerns.

Accordingly, a common problem has been the need for more casting capacity and in particular capacity for large parts, such as those which are produced on 1200 ton and larger casting machines. Reliable, economical metal transfer systems for the transport of molten metal in such large quantities has only partially been met by the industry.

One transfer system that is capable of transporting large quantities of molten metal employs the use of gravity to move the molten metal via a siphon tube from the holding pot to a die casting machine. Such a gravity metering system is described in a paper by O. Hustoft and E. Estergaard, entitled "Gravity Metering for Magnesium Cold Chamber Die Casting", delivered at a symposium of the "Society of Die Casting Engineers, Inc." on May 11–14, 1987 in Toronto, Canada.

Although gravity metering systems are in use today and have achieved a measure of success, they still suffer from a number of drawbacks. One obvious drawback lies in the fact that the holding pot must be positioned at an elevated level which poses some danger to the operator due to the higher level of molten metal and movement of the siphoning tube vertically up and down over a shot delivery apparatus for injecting a quantity of molten metal into the die of a die casting apparatus. In addition, the metal level in the holding pot must be maintained within tight limits of about plus or minus 0.4 in. (about 1 cm) of the optimum level to achieve consistent metering. Although the gravity metering system is capable of metering molten metal at rates of from 1.7 to 2.6 lb/sec. (0.8 to 1.2 Kg/sec.) for making large parts, it is not capable of metering portions of molten metal on the order of less than 1 lb (0.45 Kg) for making relatively small parts. The system also requires frequent replacement of a valve for holding or retaining the molten metal in the siphoning tube. The valve usually consists of a simple ball valve which, over a period of time, accumulates a layer of metal and metal oxide on the valve seating surface, thus developing a leak allowing a portion of the molten metal to flow back into the melting pot or allowing the metal to continue flowing into the shot delivery apparatus even when it is not desired.

Other methods for conveying molten metal include the use of systems for pumping the molten metal out of a holding pot and delivering the metal through heated conduits to the die of a die casting apparatus. Critical to the operation of such systems are the pumps that are employed for conveying the molten metal. Various types of pumps can be used, including gas displacement, positive displacement (piston or plunger), centrifugal, or electromagnetic pumps.

Gas displacement pumps use gas pressure to force molten metal from a sealed vessel through a transfer tube one end of which is submerged in the molten metal and the other end of which extends externally of the sealed vessel. The application of a head of pressure to the molten metal in the sealed vessel by the pump forces the metal out of the vessel into the transfer tube and into the shot delivery apparatus. A valve is provided in the transfer tube and may be a simple ball check valve or a pneumatically or hydraulically actuated valve. The valve, when closed, allows the holding pot to be pressurized from an external source of a pressurizing gas. When the valve is opened, pressure exerted onto the molten metal in the holding pot forces the metal through the transfer conduit into a shot delivery apparatus. A typical valve is disclosed in U.S. Pat. No. 3,726,305 issued to S. C. Erickson et al. The most common problem with this type of pump is in its inconsistent delivery of shots, i.e. varying amounts or volumes of the molten metal are delivered to the shot delivery apparatus due to leakage of the molten metal past the check valve seat. Accordingly, a periodic cleaning of the check valve is required, which is difficult and time consuming. Other disadvantages include the fact that small castings of less than 1 lb. (0,45 Kg) can not be made and that the heated transfer tube frequently becomes plugged up with the metal.

Positive displacement pumps have a plunger or piston arrangement which make it difficult to prevent molten metal from becoming lodged between the cylinder and the piston to the extent that the piston can not perform its intended transfer motion. In effect, the piston becomes "stuck" in the cylinder and must frequently be removed from the cylinder for cleaning purposes.

In centrifugal pumps, the required head pressure and flow rate is small, therefore efficiency is not a primary concern. The head pressure is produced by rotating an impeller inside of a circular housing which has a tangential discharge. While centrifugal pumps are effective in moving large quantities of molten metal, they cannot meter small quantities of metal without an improved control scheme. They also suffer from the disadvantage that they have moving parts, i.e. the impeller.

An important consideration in the metal handling arts is that any moving parts for conveying molten metal to a casting machine inherently complicates the system and poses difficult problems in maintaining the system troublefree.

Of the various pumping systems available today, the preferred pump employed in the present invention is an annular linear induction or electromagnetic pump (EM pump) which does not employ any movable parts and which is capable of sustained operation over long periods of time even while the pump is submerged in the molten metal.

SUMMARY OF THE INVENTION

Speed and accuracy in the delivery of a shot of molten metal is essential for reliable operation of a die casting facility. The present invention, by combining several components and functions, provides an automatic system for delivering shots of a molten metal, particularly magnesium, aluminum, or alloys of magnesium or aluminum to the die of a die casting machine with minimal exposure of the metal to the ambient atmosphere and at reproducible pressures and quantities to utilize the casting system of the invention to the fullest potential. The term "alloys of magnesium or aluminum" implies that the magnesium or aluminum is present in an amount greater than 50% by weight of the total weight of the alloy.

The present invention essentially relates to the delivery of shots of molten metal, rapidly, repeatedly, and in consistent amounts, to one or more molds or casting dies to assure a complete filling of each mold or die and without conveying an excessive amount of the molten metal to the die which would not be utilized in the cast part. An excess amount of solidified metal which extends into the shot sleeve of the shot delivery apparatus is generally referred to as a "Biscuit". More specifically, the term applies to that volume of solidified metal which extends from the mating surfaces of a pair of die halves part-way into the shot sleeve of the shot delivery apparatus. The biscuit is formed after the ram has completed a shot of molten metal into the die during the casting operation of an article and after the molten metal has cooled suffiently to solidify.

The present invention relates to an automatic molten metal handling and transfer system that is capable of meeting the aforementioned demands for the rapid and consistent fabrication of high quality die cast parts. More specifically, the automatic system of the invention is capable of monitoring and controlling the transfer of an exact quantity of molten metal, repeatedly and with every shot, to the die of a die casting machine to thereby assure the formation of a minimal biscuit, i.e. a predetermined amount of solidified metal extending a minimal distance into the shot sleeve, and to maintain the quality and integrity of each casting.

By the term "quantity" or "amount" used herein it is meant that the quantity of metal that is transfered from the furnace or holding pot to the die casting machine is determined by its volume or weight. It is also contemplated, within the scope of the present invention, to determine the porosity of a casting which can be readily calculated based on the relationship of volume and weight.

The term "holding pot" is used herein to incorporate containers or vessels that are designed for holding or storing a quantity of molten metal, a melting furnace which has the ability to melt and store a quantity of the molten metal, or a combined melting furnace and holding pot. A combined melting furnace and holding pot is described in the publication "Precision Metal" of February 1976 in an article entitled "Fluxless melting-/automatic metering cuts Mg die casters' cost, boosts productivity".

The system can best be described in terms of control loops for monitoring and controlling the function of various operating components of the automatic casting system of the invention. The loops comprise the following;

1) A first sensing device 84 for measuring the biscuit length of a casting following each sequential injection of a quantity of metal from a shot sleeve 64 into a die 14. The first sensing device is operatively connected to a controller (PLC) for transmitting signals to the controller indicative of the length of a biscuit 14c extending into the shot sleeve 64 following the completion of each injection. The PLC is programmed to monitor the volume of each shot and to control the supply of molten metal to the shot sleeve. The PLC is also programmed to control the operation of an actuating mechanism 68 for the sequential injection of shots of molten metal by a ram 60 from the shot sleeve into the die 14.

2) Optionally, a second sensing device 70 is provided for sensing the temperature of the molten metal 12 in the melting pot 10. The second sensing device is operatively connected to a first temperature controller (TC-I) which is responsive to the temperature sensed by the second sensing device for controlling the supply of electric power from a power supply 28 to an electric heating coil 24 for the holding pot. The second sensing device 70 is also operatively connected to the PLC which monitors the temperature of the molten metal in the holding pot and which controls the operation of TC-I and the supply of power to the heating coil to maintain the temperature of the metal within a predetermined range.

3) Preferably, the PLC is operatively connected to the power supply 28 and a transformer 82 which, in turn, is connected to the EM pump. The PLC controls the operation of the pump for conveying shots of molten metal from the holding pot to the shot sleeve 84. More specifically, the PLC controls the level of power to the pump, the direction of flow of molten metal through the pump, and the duration of operation of the pump.

4) Preferably, a third sensing device (74) is provided for sensing the temperature of the molten metal in the molten metal transfer system 16. The third sensing device is connected to the PLC and to a temperature controller TC-II for transmitting signals indicative of the sensed temperature to the PLC and the TC-II. The PLC is programmed to monitor the temperature of the transfer system and to maintain the temperature within a predetermined range. TC-II is responsive to signals from the third sensing device and the PLC for controlling the supply of electric power from the power supply 28, via transformer 40, to the transfer system to maintain the temperature of the transfer system within the programmed range set by the PLC.

5) Optionally, a fourth sensing device (72) is provided for sensing the level of molten metal in the melting pot. The fourth sensing device is operatively connected to the PLC for monitoring the level of molten metal in the pot and for controlling the operation of an indicator (not shown) for giving a visual or audio signal when the molten metal in the pot falls outside of a predetermined optimum level.

The operation of the first loop (1) for delivery of a shot of molten metal into the shot sleeve is preferably interconnected with the operation of the second loop (2) for controlling the temperature of the molten metal in the holding pot. Any change in the temperature of the molten metal in the pot, such as may take place following the addition of solid or molten metal into the pot, affects the delivery of molten metal to the shot sleeve and the injection of a precise quantity of metal into the die. Thus, the temperature must be controlled by increasing or reducing the supply of power to change the temperature to the level as programmed in the PLC. If the temperature falls outside of the predetermined set range of the PLC, the PLC will shut off the system.

The operation of the first loop (1) is preferably interconnected with the operation of the second loop (2) as well as the third loop (3) for controlling the operation of the pump. In response to signals received by the PLC from the first sensor 84, the PLC controls the level of power, the length or duration of operation, and the direction of flow of the pump. If a greater quantity of molten metal is required for injection into the shot sleeve, as determined by the PLC, the level and duration of power to the pump is increased to deliver a larger quantity of metal to the shot sleeve. If the temperature of the molten metal decreases, resulting in an increase in the viscosity of the metal, the PLC controls the operation of the power supply to the pump to increase the output of the pump.

The operation of the first, second and third loops are preferably coordinated with the operation of the fourth loop (4) for controlling the temperature of the transfer system. Any drop in the temperature of the transfer system is sensed by the sensor 74 and corrected through the control of TC-II by an increase of power to the transfer system or by an increase in the output of the pump.

The provision of the fifth loop (5) is optional, but provides a convenient and effective means for sensing the level of molten metal in the holding pot and for signaling the operator when a replenishment of metal into the pot is necessary to maintain the level within the programmed range of the PLC.

In an alternative mode of operation of the system, the first sensing device 84 for measuring the biscuit length of a casting following each sequential injection of a quantity of metal from a shot sleeve 64 into a die 14 can be omitted. In its stead, solidified castings can be manually or automatically removed from the die and transferred to a sensor to determine their weight. This information is automatically transmitted from the sensor to the PLC. The PLC is still programmed, as in the case of receiving data from the first sensing device 84 for measuring the biscuit length, to monitor the weight of each shot and to control the supply of molten metal by the pump to the shot sleeve.

A further object of the invention resides in the determination of the porosity of a casting. Such determination of perosity can be important as it affects various physical properties of metal such as strength, corrosion performance, etc. Porosity can be determined by simple calculation based on the available data of weight and volume of the cast part.

These and other features of the invention will become apparent to those skilled in the art to which this invention pertains from the following detailed description and accompanying drawing.

BRIEF DESCRIPTION OF THE DRAWING

The single drawing is a schematic diagram of a preferred molten metal conveying system of the present invention. Several components of the system are illustrated in cross section and none of the components are drawn to scale.

DETAILED DESCRIPTION OF THE INVENTION

In accordance with the present invention and with particular reference to the drawing, the molten metal handling system preferably comprises a combined melting furnace and holding pot 10 containing a quantity of a molten metal. Optionally, the molten metal handling system can be made up of a separate furnace and holding pot in which the holding pot can be supplied with a quantity of molten metal from the separate melting furnace or by manual or mechanized addition of ingots. When the molten metal is magnesium or an alloy of magnesium, the holding pot is preferably constructed of a carbon black steel or a suitable non-nickel containing stainless steel (SS) such as, for example, 430 SS to prevent contamination of the molten metal with other metals, particularly Nickel, that is present as an alloying component in ordinary stainless steel. The preferred system is described in the previously mentioned publication "Precision Metal" of February 1976, incorporated herein by reference, in which the melting furnace and holding pot are combined in a single container having a partition extending between a melting portion and a holding portion. The partition is preferably provided with a filter baffle for cleaning the metal of any particulate material, such as dross, as it passes from the melting portion to the holding portion. Melting of the metal is conducted by a gas fired burner which is also within the capability of the handling system of the invention.

The furnace or holding pot 10 is remotely located with respect to a mold or die 14 of a die casting machine (not shown). A molten metal transfer system 16 is provided for conveying the molten metal from the holding pot 10 to a shot delivery apparatus 18. The shot delivery apparatus 18 comprises a piston or ram 60 which is positioned, for reciprocating movement, in a chamber 62 of a shot sleeve 64. The shot sleeve is provided with an inlet opening **64*a* to allow for the flow of molten metal into the chamber of the sleeve. The ram is connected by a rod 66 to a hydraulic actuating mechanism 68 for moving the ram 60 between a retracted position and an extended or charging position in which molten metal is discharged, under pressure, from the sleeve 64 through an inlet 14*b* into a die cavity or chamber 14*a* of the die 14**.

It will be understood that any actuating system, other than a hydraulic system, can be employed for moving the ram between the retracted and extended or charging positions. The die casting machine can be of a standard design and may be selected from a high or low pressure, continuous or intermittent casting machine, sand molding table(s), or the like. It is to be understood that the automatic handling system described herein can also be applied to a strip caster.

The holding pot 10 is positioned within a housing 11 in a spaced relationship therewith, forming a chamber **11*a* between an outer surface of the holding pot and an inner surface of the housing 11. The holding pot 10 is heated by an electrical resistance heating coil 24 positioned in the chamber 11***a* in a spaced relationship from an outer surface of the holding pot. It will be understood that other means of heating the metal in the holding pot can be employed such as by, for example, induction heating or heating by burning a fuel, such as natural or synthetic gas, in a combustion chamber, such as chamber 11*a*, between the housing 11 and the pot 10. The housing 11 is provided with a layer of a suitable thermal insulating material 17, preferably comprising a layer of ceramic refractories which are mounted to the inner wall of the housing 11. The ceramic refractories serve not only as a thermal insulation for the furnace but also as an electrical insulation for the resistance heating coil(s) 24 which is mounted adjacent to the refractories. The refractories are also non-reactive with the molten metal, particularly if the metal is magnesium, thereby improving the safety of the system in the event the holding pot develops a leak where the molten metal could flow into the space between the holding pot and the housing 11.

The holding pot is provided with a removable hood or cover 22 which is seated on a flange 10*a* of the holding pot. The hood is preferably sealed to the holding pot by a heat resistant gasket (not shown) to maintain a protective atmosphere in the melting pot. When the molten metal is magnesium or an alloy of magnesium, it is important to prevent contact between the molten metal and the atmosphere to prevent oxidation of the molten metal. Reference is made to "Melting Magnesium under Air/$SF_6$ Protective Atmosphere", by S. L. Couling, in 36th Annual World Conference on Magnesium, Oslo, Norway, June 24 to 28, 1979, International Magnesium Association.

The hood 22 is preferably provided with a raised section and an inclined access opening provided with a sliding door (not shown) to allow for the introduction of metal as well as tools into the interior of the melting pot, as illustrated and described in the aforementioned publication "Precision Metal" of February 1976. Tools, such as skimming tool are occasionally used to remove dross from the surface of the molten metal.

Preferably, the protective atmosphere employed in the system of the present invention consists of a mixture of air with a small percentage of $SF_6$, on the order of from about 0.1% to about 0.7%. The protective gas is supplied from a source such as a tank 13 containing a mixture of the $SF_6$ with air, or a concentrate of $SF_6$ which can be admixed with air or a mixture of air and $CO_2$, prior to introduction of the gas into the holding pot. The tank is provided with a valve 13*a* for turning "on" or shutting "off" the flow of gas. A supply line 13*b* is connected between the valve and a flowmeter 15 for conducting the gas from the tank 13 to the holding pot 10. The flowmeter 15 is adjustable to allow for a continuous flow of the gas, at a predetermined rate, into the melting pot through an inlet conduit 15*a* extending through an opening in the cover 22. The rate of gas supply and the concentration of the protective gas is adjustable to assure sufficient protection of the melt from oxidation even during periodic opening of the access door to the melting pot.

The automatic handling system of the present invention preferably employs an electromagnetic pump 32 which is preferably fully submerged in the molten metal 12 in the holding pot 10. The pump 32 has an inlet end 32*a* for drawing molten metal out of the pot and an outlet end 32*b* connected by a connector or coupling 32*c* to an inlet end of an inner conduit 34 of the molten metal transfer system 16 for conveying the molten metal from the melting pot through the inner conduit to the shot delivery apparatus 18. It will be appreciated that the transfer system illustrated and described herein is a preferred system and that it is not essential to the operation of the automatic handling system of the invention. The transfer system can also be a simple open trough that is inclined with respect to the horizontal to allow molten metal to flow by gravity from an outlet provided near the bottom of the holding pot into the shot delivery apparatus 18. A shut off valve is provided to control the flow of molten metal from the outlet of the holding pot to the trough. It will be appreciated that the bottom of the holding pot is at a higher elevation than the shot delivery apparatus 18 to assure sufficient gravity flow of the molten metal into the shot delivery apparatus. The open trough is preferably covered by an enclosing hood and supplied with a protective gas to prevent oxidation of the metal during transfer to the shot delivery apparatus. Alternatively, the open trough can be placed into a housing to form a combustion chamber between the housing and the trough for burning of a fuel, such as gas, in the chamber to maintain the temperature of the molten metal flowing in the trough at a desired level. Other variations of the transfer system will be apparent to persons skilled in the art.

The EM pump can be readily disconnected from the inner conduit for cleaning or repair by removing the connector 32*c*. The EM pump creates a flow of the molten metal perpendicular to the direction of the flux return path generated by the windings of the pump as a voltage is applied. The flux return path is created through the use of a cobalt alloy core rod that is positioned in the center of a duct tube. Thus, molten metal can flow through the annular space between the core rod and the duct tube. Because there are no moving parts or valves associated with the pump, chances of a mechanical failure are remote. For a more detailed description of the construction and operation of EM pumps, reference is made to U.S. Pat. No. 4,828,459, issued on May 9, 1989, to H. C. Behrens, incorporated herein by reference, and to "Handbook of Electromagnetic Pump Technology" by R. S. Baker et al, published 1987 by Elsevier Science Publishing Co.

In the preferred system of the invention, the inner conduit 34 is concentrically positioned within a second or outer conduit 36 thereby providing an annular space between the conduits. An insulating material 38 is positioned in the annular space to provide effective thermal insulation to reduce the loss of heat from the transfer system, as well as electrical insulation to prevent electrical shorting between the conduits.

Where the transfer system 16 is designed for conveying molten magnesium, or alloys thereof, it is desirable to construct the inner conduit from a carbon black steel or a suitable non-nickel containing stainless steel to prevent contamination of the molten magnesium with other metals, particularly Nickel, that is present as an alloying component in ordinary stainless steel conduits. Preferably, the conduit system of the invention utilizes a $\frac{3}{4}$ in. (1.9 cm) diameter 40 carbon steel pipe as the inner conduit and a 2 in. (5 cm) diameter 80 black carbon steel pipe as the outer conduit.

The inner conduit 34 is preferably kept filled with the molten metal to a level where the miniscus 37 of the molten metal is level with the outlet opening of the inner conduit. Preferably, a non-reactive or inert gas purge is used to prevent oxidation of the molten metal during transfer of the metal from the inner conduit to the shot delivery apparatus 18. It is also important that the transfer system 16 is designed such that an unintentional siphon can not occur. To prevent unintentional siphoning, the transfer conduit is inclined at an angle of preferably greater than about 10 degrees with respect to the horizontal. The angle is chosen to assure that the inner conduit 34 is substantially filled with molten metal at all times during the casting operation.

The conduit system 16 of the invention is preferably provided with an electric heating system for maintaining the temperature of the molten metal in the inner conduit 34 within a predetermined range. The heating system includes the power supply 28 which is connected to a transformer 40 by power cable 28*a*. The transformer is connected by power cables 40*a* and 40*b* to the outer conduit. The transformer 40 is preferably a 150 kva single phase, water cooled transformer, manufactured by Kirkhof, which produces a low voltage on the order of from 5 to 14 volts, and a high current, on the order of 2000 amperes or higher. An electric current is conducted from the transformer 40 to the outer conduit 36, from the outer conduit to the inner conduit 34, and from the inner conduit back to the transformer, or vice versa, thus completing the electric circuit.

In a preferred embodiment of the invention, the outer conduit 36 consists of two or more separate conduit sections, two such sections being illustrated in the drawing. A temperature sensor or thermocouple 74 is connected to, or placed in close proximity to, the inner conduit at one or more strategic locations, where the outer conduit sections are separated from each other, to sense the temperature of the inner conduit. A separation of the outer conduit sections can be made at any convenient location, but is usually made at about the midpoint along the length of the inner conduit or at equally spaced distances along the length of the inner conduit. Where two or more thermocouples are used, a temperature profile of the temperature of the inner conduit can be obtained. The power cable 40*a* is attached to a connector or clamp 41*a* which, in turn, is attached to one end of a first outer conduit section. At the opposite end of the first section, an electrically conductive connector 44*a* connects the first outer conduit section to the inner conduit 34 to provide a flow path for the electric current from the first outer conduit section to the inner conduit. At the opposite end of the inner conduit 34, adjacent to the shot delivery apparatus 18, an electrically conductive connector 44*b* connects the inner conduit to a second section of the outer conduit to provide a flow path for the electric current from the inner conduit to the second section. A second connector or clamp 41*b* is connected to the terminal end of the second section for conducting an electric current by means of cable 40*b* from the transformer to the second section. An electric current path is thus established whereby the current can flow from the transformer to one section of the outer conduit, thence to the inner conduit, from the inner conduit to the second outer conduit section, and back to the transformer 40.

It will be understood that the outer conduit need not be in two or more separate sections, but that the electrical connection from the transformer 40 can simply be made at one end of the outer conduit. The current then flows from one end of the outer conduit to the opposite end where a connector provides a connection from the outer conduit to the inner conduit for flow of the current from the outer conduit along the entire length of the inner conduit for return to the transformer. A thermocouple can be connected to the inner conduit at a point where the inner conduit projects from the outer conduit.

In view of the larger size and the cooler temperature of the outer conduit or conduit sections, the outer conduit has a relatively low electrical resistance and, accordingly, will allow a current to flow through the outer conduit substantially without causing a substantial resistance heating of the outer conduit. As the current flows through the inner conduit 34, it encounters a higher electrical resistance due to the smaller diameter of the inner conduit and the fact that the inner conduit is maintained at a much higher temperature due to the flow of molten metal through the inner conduit. Since the transfer system is basically a conduit within a conduit, electrical resistance heating utilizing the conduits themselves assures a more uniform heating over the entire length of the inner conduit. A larger cross-section of the outer conduit wall in the transfer system performs better in that the resistance change or current density change is minimized when molten magnesium fills the inner conduit. Accordingly, electrical resistance heating of the inner conduit 34 itself is an effective manner for controlling the supply of electric power to the transfer system and for maintaining the molten metal within the inner conduit at the desired temperature and within a predetermined temperature range. In the preferred system, the temperature controller TC-II includes a control board (not shown) such as, for example, a model PTR 1000 manufactured by Phasetronics. TC-II effectively controls the input of power from the power supply 28 to the transformer 40 and is responsive to the input signals from the sensor 74. TC-II is connected to the PLC which monitors the temperature of the inner conduit to assure that the temperature of the inner conduit stays within a predetermined range. An electrically heated transfer system, similar to the one described hereinabove is disclosed in U.S. Pat. No. 2,568,578, issued on Sep. 18, 1951 to F. C. Bennett.

Other methods of heating the inner conduit can be employed and are well known in the art. For example, the inner conduit can be heated by induction heating wherein a coil of a conductive cable is wound around the inner conduit. Another heating system would include a series of electrical resistance heating rods, such as Calrod units, which are capable of carrying 220–240 volts AC power, and which surround the inner conduit. One such heating system is described in U.S. Pat. No. 4,635,706, issued on Jan. 17, 1987 to H. C. Behrens.

The inner conduit 34 is of a length such that it extends a short distance beyond the end of the outer conduit 36, as illustrated. A hood 46 is suitably connected to the end of the outer conduit to provide an open ended chamber 46*a* between the inner conduit and the hood. The hood is bent at an angle so that a portion thereof extends in a substantially vertical direction. An outlet end of the hood is positioned in alignment with the shot delivery apparatus 18 for conveying shots of molten metal to the shot sleeve of the shot delivery apparatus. Preferably, the inner conduit 34 is provided with an extension 35 which is removably connected, by means of a suitable connector 35*a*, to an end of the inner conduit 34. The extension 35 is bent downwardly at an angle to extend in a substantially vertical direction, so that an outlet end 35*b* thereof can be positioned into exact alignment with an inlet opening 64*a* in the shot sleeve 64 for easy conveyance of the molten metal into the chamber 62 of the sleeve.

The hood 46 is provided with an inlet port for supplying an inert gas, such as argon, to the hood to prevent oxidation of the molten metal flowing from the inner conduit into the shot delivery apparatus 18. The supply of gas to the hood is particularly desirable if the inner conduit extension is not used such that the molten metal would flow from the end of the inner conduit 36 into the hood and along an inner surface thereof to the shot sleeve, thereby becoming more exposed to the atmosphere. The system for supplying the inert gas to the hood is similar to the system described hereinabove for supplying a protective gas from tank 13 to the holding pot. Here again, the inert gas is supplied from a gas source, such as a tank 50, to the hood 46. The tank 50 is provided with a manual control valve 50*a* for turning the flow of gas "on" or "off". A supply line 50*b* is connected between the valve and a flowmeter 52 for controlling the flow of the gas from the tank to the hood. The flowmeter 52 is adjustable to allow for a continuous flow of the gas, at a predetermined rate, through a gas supply line 52*a* extending through the inlet port into the hood. The rate of gas supply and the concentration of the gas is adjustable to assure sufficient oxidation protection for the molten metal.

Preferably, the hood 46 is removably connected to the end of the outer conduit 36 to facilitate cleaning of the hood and outer conduit. A suitable connecting means can be a simple bolted flange, or the like (not shown). Removal of the inner conduit extension 35 facilitates cleaning of the extension as well as the interior of the inner conduit.

For a fully automatic system, a plurality of sensors are provided to sense various conditions or parameters of the system. The sensors transmit signals, indicative of such conditions or parameters, i.e. variations in temperatures and level of molten metal in the pot to the PLC for monitoring and/or controlling the sequence of operation of the system.

More particularly, in order to maintain a consistent quality of each die cast part, it is critical that a consistent volume of molten metal be delivered to the shot sleeve 54 with each casting operation. For the determination and control of a consistent shot volume, the first position sensor 84 can be, for example, a transducer, preferably a linear variable displacement transducer (LVDT) or position sensitivity transducer made by Celesco, to provide a signal indicative of the length of travel of the rod 66 for moving the ram 60 from the retracted to the extended position, thus providing, in the preferred embodiment, a measurement of the biscuit length 14*c* of each casting.

The first or position sensor 84 is positioned adjacent to the rod 66, as indicated by dotted line 84*a*, to measure the distance traveled by the ram (stroke) from a fully retracted position to a fully extended position. After completion of the stroke for transferring a quantity of molten metal from the chamber 62 of the shot sleeve 64 into the die 14 and prior to opening of the die, the sensor transmits a signal, through electrical conductor 84*a*, to the Programmable Logic Controller (PLC) which is connected by electrical conductor 80 to the power supply 28. Preferably, the PLC is a Mini-PLC-2/16 made by Allen-Bradley Company, Inc. Since the length of travel of the ram is fixed by the length of the sleeve 64, a shorter length of travel is indicative of a greater length of the biscuit extending into the sleeve. Thus, a signal from the sensor, which is indicative of the length of travel of the ram, enables the PLC to calculate the volume of the biscuit extending into the sleeve, based on a simple calculation of the length of the biscuit and the diameter of the chamber 62. If required, the PLC transmits instruction signals to the power supply and transformer 82 for an increase or decrease in the level of power, and/or the duration of operation of the pump, for the transport and delivery, by the pump, of a correspondingly larger or smaller amount of molten metal from the melting pot to the shot delivery apparatus.

The PLC thus controls the delivery of a predetermined quantity of the molten metal to the shot delivery apparatus to fill the chamber 62 of the sleeve 64. The hydraulic actuating mechanism 68 is connected by electrical conductor 68*b* to the PLC. After a predetermined quantity of the molten metal has been delivered to the chamber of the shot sleeve, the hydraulic actuating mechanism 68 is actuated by the PLC to move the ram 60 forward, thereby closing off the inlet 64*a* to the chamber 62. The ram then proceeds to move rapidly forward, pushing the molten metal, under pressure, into the cavity 14*a* of the die 14 until it reaches its extended or forward most position. Upon solidification of the metal in the die, the ram is retracted, the die is opened, and the cast part is ejected from the die. After the ram reaches its fully retracted position, the die is closed and the PLC repeats the programming cycle for supplying another shot of molten metal to the sleeve.

A modification of the system which does not rely upon a determination of the bisquit length and volume of metal of the casting and which does not require the presence of a sensor for transmission of signals, indicative of the bisquit length, to the PLC is contemplated within the scope of the invention. In such an alternative system, a solidified casting is removed from the die or mold and is placed on a scale (not shown) to determine th weight of the casting. Removal of the casting from the mold can be done with an automized handling system (not shown) that can open the die, remove the solidified casting from the die, and place the casting on a scale. The scale is provided with a sensor (not shown) that is connected to the PLC to transmit a signal, indicative of the weight of the casting measured by the scale, to the PLC. Responsive to the information (signal) received from the sensor and the programmed information in the PLC, the PLC will transmit, if called for, a signal to the power supply 28 and transformer 82 to increase or decrease the power supplied to the EM pump or to increse or decrease the duration of operation to the pump. Accordingly, automatic control of the system, based on the weight of the casting, can be readily established with an automatic weighing and sensor system under the control of the PLC.

A further aspect of the invention allows for a simple conversion of the data received by the PLC to determine the porosity of a casting. Since the theoretical density of a particular metal or metal alloy that is being cast is known, and since the actual weight and the biscuit length of the casting can be determined by the procedure herein before described, the PLC can perform a calculation to convert this information into data to accurately determine, in effect, the percentage of the volume of space in the casting that is occupied by gas bubbles, i.e. void space, thus permitting the operator to determine whether a particular casting meets the requirements or standarts of the part cast.

The PLC is also programmed to reverse the direction of flow of molten metal in the pump. Thus, if it is desired to shut down the casting operation, the pump flow is reversed to allow the molten metal to flow back into the melting pot to prevent the formation of solidified metal or metal oxide on the inner surface of the inner conduit.

A second sensor 70 is suitably positioned in the holding pot 10 within the molten metal 12, or in close proximity of the molten metal, for sensing the temperature of the molten metal. Sensor 70 preferably is a commercially available type K thermocouple which is connected by an electrical conductor 70*a* to the PLC to provide the PLC with a signal indicative of the temperature of the molten metal. The PLC is programmed to monitor the temperature of the molten metal and is operative to turn the system off if the temperature of the molten metal falls outside of a range that is preset in the program of the PLC. Signals, indicative of the temperature of the molten metal, are also transmitted by electrical conductors 70*a* and 70*b*, from the sensor 70 to the first temperature controller TC-I which is connected by electrical conductor 70*c* to the power supply 28. Any commercially available temperature controller can be used although it is necessary that the controller be compatible with the signal received from the sensor 70. Depending on the temperature sensed by sensor 70 and the temperature monitored by the PLC, TC-I controls the supply of power from the power supply 28 to the coil 24 by either turning the power "On" if the temperature sensed is too low, or by turning the power "Off" if the temperature sensed is too high. Thus, the temperature of the molten metal is continuously monitored and controlled by the PLC and TC-I to stay within a predetermined range. It will be understood, that the heating coil can also be operated in a continuous manner and without shutting off the supply of power to the coil except when it is desired to deactivate the system. Thus, TC-I can be programmed to raise or lower the level of power to the coil to continuously maintain the temperature of the molten metal within predetermined limits. When the molten metal is magnesium or aluminum or an alloy of magnesium or aluminum, it is preferred to maintain the temperature of the molten metal in the melting pot by the temperature controller within the range of from 600° C. to 750° C.

The PLC is also programmed to control the supply of power to the pump 32 as well as the time of operation of the pump. Power is supplied to the pump from power supply 28 which is connected to the transformer 82 through power cable 82*a*. The transformer 82, herein illustrated as a single transformer, preferably consists of three, single phase 3 KVA, transformers to produce a three-phase 110 vac (110 volts phase-to-phase) power supply. To achieve the fine control needed for operation of the pump and for metering the molten metal to the shot sleeve, the transformer is connected to a control board (not shown) which controls the level of power to the pump as required by the PLC. The control board is commercially available and preferably is a model PTR 6000, made by Phasetronics. The PLC is also connected to a switching device (not shown) in power line 82*a* to control the operation of the transformer 82. The pump is continuously energized, generally referred to as the "idling speed", to maintain a constant pressure head on the molten metal in the inner conduit 34 sufficient to keep the inner conduit filled where the miniscus 37 of the molten metal is substantially level with the highest point of elevation of the inner conduit and without causing the molten metal to leak out of the end of the inner conduit or into the extension 35. Maintaining the inner conduit filled with molten metal at all times maintains the inner surface of the conduit free from solid metal and metal oxide deposits that could gradually block the flow of metal through the conduit. Such deposits are formed if the molten metal were to be drained out of the conduit into the pot between shots of molten metal into the shot delivery apparatus 18. It is also advantageous to maintain the conduit filled with molten metal for speed and accuracy of operation in rapidly supplying an exact quantity of molten metal with each shot to the shot delivery apparatus.

The third sensor 74 is operatively connected, as indicated by dotted line 74*a*, to the inner conduit 34 at the position where the outer conduit sections are separated from each other. When the sensor is a thermocouple, it is preferable to place the thermocouple into direct contact with the inner conduit for a more accurate sensing of the temperature. As previously indicated, a plurality of sensors can be provided at spaced intervals along the length of the inner conduit and in the openings provided between spaced outer conduit sections. The number of sensors is somewhat dependent on the length of the transfer system. When several sensors are employed, a more accurate profile of temperature variations along the length of the inner conduit is obtained.

The third sensor 74 is connected to the PLC by an electrical conductor 74*b* to provide the PLC with signals indicative of the prevailing temperature of the inner conduit. The PLC is programmed to monitor the temperature of the inner conduit to fall within a predetermined range. The PLC is connected by an electrical conductor 80*a* to the temperature controller TC-II which is connected by an electrical conductor 80*b* to the transformer 40 to control the supply of power to the transfer system 16 by operating a switch (not shown) in power cable 28*a* to connect or interrupt the supply of power from the power supply 28 to the transformer 40. TC-II is also connected by conductor 74*c* to receive signals from the third sensor 74, indicative of the temperature in the inner conduit. The supply of power from the transformer 40 through power cables 40*a* and 40*b* to the outer conduit portions is therefor controlled by TC-II during the time that the sensor 74 transmits signals indicative of changes in the temperature of the inner conduit. In the event that the temperature sensed by the sensor fails outside of the programmed temperature range of the PLC, the PLC is programmed to shut down the system.

Optionally, the fourth sensor 72 is positioned fin the holding pot 10 in proximity to the surface of the molten metal for sensing changes in the level of molten metal in the pot. Preferably, the sensor is mounted on the underside of the hood or cover 22 and is connected by an electrical conductor 72*a* to the PLC. A suitable sensor is, for example, an inductive proximity probe which is commercially available from Siemens Energy and Automation, Inc. Changes in the level of molten metal are sensed and transmitted as electric signals to the PLC which is programmed to monitor the level of metal in the pot. Responsive to signals received from the sensor 72, the PLC operates an indicator for giving a visual or audio signal when the molten metal falls outside of a predetermined level in the pot, thus enabling the operator to determine when there is a need for introducing additional metal into the melting pot. It will be understood that the sensor will also provide a signal to the PLC indicative of an excess of metal in the pot. The fourth sensor 72 is not essential if the level of the molten metal in the melting pot is carefully monitored by the operator and maintained within a range where it does not affect the operation of the pump. If the level of the molten metal in the holding pot drops too much, the pressure head of the pump is reduced where it will not keep the inner conduit completely filled during the intervals between the delivery of shots to the shot delivery apparatus.

The amount of power delivered from the transformer to the pump 32 is increased upon command from the PLC upon the receipt of an input signal from the sensor 84 which is indicative of the complete withdrawal of the rain in the shot sleeve and closure of the die. The power level is maintained for a predetermined period of time, under the control of the PLC, to convey a predetermined quantity of the molten metal from the inner conduit into the chamber 62 of the sleeve 64. During the filling operation, the PLC turns off the power to the transformer 40 for heating the transfer system, to prevent the flow of a transient current from the transfer system to the die casting apparatus along a current path created by the flowing metal when it comes into contact with the shot sleeve of the casting apparatus. Upon completion of the filling operation, the delivery of power from the transformer 82 to the pump 32 is reduced to return the pump to the "idling speed". Immediately following the return of the pump to "idling speed", the PLC transmits a signal to the casting machine to make the shot.

It will be understood that the use of an electromagnetic pump does not entail any moving parts such as a rotor or impeller and that the term "idling speed" as used herein refers to the supply of power to the electric coils of the pump to maintain a pressure head on the molten metal sufficient to keep the inner conduit filled. The pressure head being dependent upon the inner diameter of the inner conduit, the length of the inner conduit, the inclination of the transfer system with respect to the horizontal, etc.

In operation, the automatic handling system of the invention is monitored and/or controlled by the PLC which can be programmed to perform the following functions;

1) Operation of the hydraulic actuating mechanism 68 for moving the ram 60 between the retracted position and the extended or charging position for charging a shot of molten metal into the die 14 of the die casting machine.

2) Supply of electric current to the coil 24 to maintain the temperature of the molten metal in the melting pot within a desired range.

3) Supply of electric current from the transformer 40 to the transfer system 16 to maintain the temperature of the inner conduit within the desired range, and 4) Supply of current from the transformer 82 to the pump for operation of the pump 32.

Although it is not essential that the PLC perform the functions listed under 2), 3) or 4) or any other minor functions to render the system fully automatic, it is preferred that the PLC be programmed so that it can exercise full control over all functions of the system for the most effective and efficient operation of the system. For example, the supply of additional metal to the holding pot can be accomplished without a molten metal level sensor and can be done by visual and/or audio indicators to warn the operator that the holding pot requires the addition of metal. This function can be performed by the operator by merely counting the number of shots and adding an ingot of a known quantity of metal to the pot every time that a predetermined number of shots, substantially equivalent to the weight of the ingot, have been completed. Nevertheless, the level sensor provides a more accurate control to maintain the level of molten metal in the holding pot within a predetermined and desired range.

Further by way of example, it is not essential that the temperature of the transfer system be controlled by electrically heyting the inner conduit. Variations in the temperature of the molten metal being conveyed by the transfer system depends to some extend on the size of the inner conduit and the amount of molten metal that is transferred, the frequency of shots, the length of the inner conduit, the degree of insulation, etc. Thus, the system can be operated without heating of the transfer system although it will be apparent to the skilled artisan that it introduces an element of inefficiency into the system if the metal is not maintained at an optimum temperature.

For similar reasons, it is not essential that the operation of the pump be monitored and controlled from the PLC. Nevertheless, for the greatest degree of efficiency and convenience, it is preferable that the PLC monitor the temperature of the molten metal in the holding pot and, responsive to the temperature, adjust the level of pumping capacity of the pump to compensate for changes in the viscosity of the molten metal. For a discussion on the viscosity of molten metals, reference is made to "Magnesium Products Design", by R. S. Busk; 1987, published by Marcell Decker.

From the forgoing description, it can be seen that the PLC, in conjunction with the several sensors and temperature controllers, is capable of monitoring and controlling the various functions of the handling system to render the system fully automatic and to assure the delivery of precise quantities of metal to the die casting machine in rapid succession.

The start up and operation of the system is more fully explained in the following working examples:

The automatic ladling system is connected to a 300 ton Excello ® B & T cold chamber die cast machine. An EM pump is installed in a 300 pound (135 Kg) capacity holding pot and heated in a 30 KW electric furnace made by MPH Industries, Inc. Approximately 260 lbs (117 Kg) of magnesium alloy AZ91D is charged to the holding pot and melted. A checklist is utilized during the initial start-up to ensure that all necessary items are complete and safety requirements are met:

1. The holding pot is full and electrically insulated from the ground. Electrical safety devices are connected and operative.

2. Utilities such as power supply, water and gas supplies are properly connected and operative.

3. The die heater is turned on to pre-heat the die.

4. Electrical connections to the outer conduit, the die cast machine, and the pump are made.

5. The pump and inner conduit are adequately preheated before charging with molten metal.

After all items are completed, as indicated above, the temperature of the molten metal in the pot is controlled at 690° C. The temperature of the inner conduit is increased in 3 stages; from ambient to 400° C., then from 400° C. to 600° C., and finally from 600° C. to 710° C. At each stage, the temperature is held for a minimum of 5 minutes before proceeding to the next stage. This is done to allow even heating of the complete length of the inner conduit.

We claim:

1. A method for delivering molten metal from a source to a mold or die of a molding or casting machine, wherein the source of molten metal is a furnace or holding pot, or a combination thereof, comprising the steps of:

(a) transferring a predetermined volume of the molten metal from said holding pot to a shot delivery apparatus through a transfer means, (b) allowing the molten metal to cool and solidify in the die following each charge, (c) determining the volume of solidified metal charged into the die, and (d) controlling the delivery of a subsequent volume of the molten metal from the holding pot to the shot delivery apparatus, in response to sequential detection of completion of a preceding charge of molten metal to the shot delivery apparatus, removal of a cast part from the die, and closure of the die; and e) weighing the casting after removal of the casting from the die, and calculating the volume of the casting based on the density of the metal in the casting.

2. The method of claim 1, wherein said shot delivery apparatus comprises a shot sleeve having a chamber, an inlet for the molten metal in said sleeve, and a ram movable in the sleeve chamber for moving a charge of the molten metal from the sleeve into said mold or die, including the step of measuring the length of solidified metal extending into the shot sleeve, and calculating the volume of the casting including the length of solidified metal extending into the shot sleeve.

3. The method of claim 2, including the step of sensing the distance of travel of the ram with each charge of a quantity of the molten metal into the die to measure the length of solidified metal extending into the shot sleeve, determining the volume and weight of the casting, and then calculating the porosity of the casting.

4. The method of claim 1, wherein the holding pot is sealed to the atmosphere, and including the step of supplying a protective gas to the sealed pot to prevent oxidation of the molten metal in the pot.

5. The method of claim 1, wherein the transfer means comprises a conduit means, and including the step of heating the conduit means, sensing the temperature of the conduit means, and controlling the supply of energy to the conduit means for maintaining the temperature of the conduit means within a predetermined range.

6. The method of claim 5, including a removable hood at an end of the conduit means adjacent to the shot sleeve of the shot delivery apparatus, and including the step of supplying an inert gas to the hood to prevent oxidation of the molten metal when it is present in the conduit means and during the transfer of molten metal into the sleeve.

7. The method of claim 1, wherein the molten metal is transferred by a pump, including the step of controlling the level of energy and duration of operation of the pump to thereby control the delivery of a predetermined volume of the molten metal from the holding pot to the shot delivery apparatus.

8. The method of claim 7, wherein said pump is an electromagnetic pump which is substantially submerged in the molten metal, including the step of reversing the direction of flow of metal through the pump to return molten metal from the transfer means to the holding pot.

9. The method of claim 7, including the step of continuously operating the pump at a reduced operating power to maintain the transfer means filled with molten metal between charges of molten metal into the shot delivery apparatus.

10. The method of claim 7, including the step of sensing the temperature of the molten metal in the holding pot with a temperature controller, and adjusting the level of power to the pump in response to the detection of a change in temperature by the controller to change the output of the pump to compensate for changes in the viscosity of the molten metal in the pot.

11. The method of claim 7, including the step of sensing the temperature of the conduit means, and adjusting the level of power to the pump in response to the detection of a change in temperature by the controller to change the output of the pump to compensate for changes in the viscosity of the molten metal in the conduit means.

12. The method of claim 7, including the step of sensing the level of molten metal in the holding pot, providing an indication when the metal reaches a level above or below a predetermined level in the pot, and adjusting the level of power to the pump in response to the detection of a change in the level of molten metal in the holding pot.

13. The method of claim 1, including a source of energy for heating the metal in the holding pot, sensing the temperature of the molten metal in the pot, and a temperature controller for controlling the supply of energy to the pot in response to a detection of a change in the temperature of the molten metal.

14. The method of claim 1, wherein the molten metal is selected from the group consisting of magnesium, aluminum, and alloys of magnesium or aluminum.

15. A molten metal transfer system for delivering molten metal from a source of molten metal to a mold or die of a molding or casting machine, wherein said source of molten metal is a furnace or holding pot, or a combination thereof, comprising:

(a) means for transferring the molten metal from said holding pot to a shot delivery apparatus connected to the molding or casting machine, said means including a pump which is at least partially submerged in the molten metal, and a source of energy connected to the pump for transfer of the molten metal from the holding pot to the shot delivery apparatus, (b) said shot delivery apparatus comprising a shot sleeve having a chamber, an inlet for the molten metal in said sleeve, and a ram movable in the sleeve chamber for moving molten metal from the sleeve into said die, and (c) a controller operatively connected to a sensor for determining the volume of molten metal charged into the die, said controller including programming means for maintaining the volume of molten metal to be transferred from the holding pot into the die within a predetermined range, and said controller being responsive to a change in the volume, as sensed by the sensor, for controlling the delivery of an adjusted predetermined volume of molten metal to the die, and (d) means for removing the solidified metal casting from the die, means for weighing the casting, and wherein said controller is adapted to determine the volume of the casting based on the weight and density of the metal in the casting.

16. The transfer system of claim 15, wherein the holding pot is sealed to the atmosphere, and means for supplying a protective gas to the sealed holding pot to prevent oxidation of the molten metal.

17. The transfer system of claim 15, wherein said sensor is adapted for sensing the distance of travel of the ram in the sleeve chamber between a retracted position and an extended or charging position following each charge of the molten metal into the die, and wherein said controller is adapted to determine the volume of metal transferred into the die following each charge, based on the biscuit length of solidified metal extending into the sleeve.

18. The transfer system of claim 15, including a temperature controller connected to a sensor and to the controller for sensing the temperature of the molten metal in the holding pot, said temperature controller being responsive to the controller for controlling the supply of power to the pump based on a change in temperature and viscosity of the molten metal.

19. The transfer system of claim 15, wherein said means for transferring the molten metal from said holding pot to the shot delivery apparatus comprises an outer conduit positioned concentrically with respect to an inner conduit for conveying the molten metal from the holding pot to the die, a thermal and electrical insulation positioned between the conduits, a connector between the inner and outer conduits at one end thereof for electrically connecting the conduits, an electrical power supply connected to the inner and outer conduits, respectively, at an opposite end thereof for conducting an electrical current through the conduits, and a temperature controller (TC-II) for adjusting the supply of current from the power supply to the conduits to control the temperature of the inner conduit.

20. The transfer system of claim 19, wherein said temperature controller is connected to a sensor and to said controller for sensing the temperature of the inner conduit, said controller controlling the level of power to the pump, based on a change in temperature and viscosity of the molten metal, for conveying a predetermined volume of molten metal from the holding pot to the die and for maintaining the inner conduit filled with molten metal.

21. The transfer system of claim 20, wherein said outer conduit comprises at least two conduit sections which are electrically separated from each other, each outer conduit section being electrically connected by a connector at one end thereof to the inner conduit, and said power supply being connected, respectively, to the opposite ends of the outer conduit sections.

22. The transfer system of claim 19, including a temperature controller (TC-I) connected to a sensor and to the controller for sensing the temperature of the molten metal in the holding pot, said temperature controller being responsive to the controller for controlling the supply of power to the pump and for maintaining the inner conduit filled with molten metal.

23. The transfer system of claim 21, wherein said power supply includes a transformer connected to the power supply and to the inner and outer conduits, respectively, for supplying a low voltage and high current to the conduits, said transformer being connected to a temperature controller for controlling the supply of power to the conduits in response to the temperature sensed by a sensor connected to the inner conduit.

24. The transfer system of claim 19, wherein said concentrically positioned conduits are inclined at an angle with respect to the horizontals a sensor for sensing the level of molten metal in the holding pot, said controller being operatively connected to the sensor for sensing the level of molten metal in the holding pot and for controlling the supply of energy to the pump to maintain the inner conduit filled with molten metal.

25. The transfer system of claim 15, including a sensor for sensing the level of molten metal in the holding pot, said controller being connected to the sensor for monitoring the level of molten metal in the pot and for providing an indication when the level of molten metal in the holding pot falls below a predetermined level and for controlling the supply of power to the pump.

26. The transfer system of claim 15, including a source of energy for supplying energy to the holding pot, a sensor connected to the holding pot for sensing the temperature of the molten metal in the holding pot, said sensor being connected to the controller for monitoring the temperature of the molten metal in the holding pot, and a temperature controller connected to the source of energy for controlling the supply of energy to the holding pot for maintaining the temperature of the molten metal within a predetermined range based on a programmed temperature range of the controller.

27. The transfer system of claim 15, including a hydraulic actuating mechanism connected by an actuating rod to the ram for moving the ram between said retracted and extended or charging positions for charging a quantity of molten metal from the sleeve into the die, said controller being operatively connected to the hydraulic actuating mechanism and to the molding or casting machine for controlling the operation of the mechanism.

28. The transfer system of claim 15, wherein the molten metal is selected from the group consisting of magnesium, aluminum, and an alloy of magnesium or aluminum.

29. The transfer system of claim 28, wherein the molten metal alloy comprises at least 50% Mg or Al.

* * * * *